United States Patent [19]

Bull

[11] 4,231,082

[45] Oct. 28, 1980

[54] LAMP ASSEMBLY LIGHT SHIELD AND RETAINING MEANS

[75] Inventor: David W. Bull, Hersey, Mich.

[73] Assignee: Nartron Corporation, Reed City, Mich.

[21] Appl. No.: 876,720

[22] Filed: Feb. 10, 1978

[51] Int. Cl.[3] ..... F21S 1/06

[52] U.S. Cl. ..... 362/368; 362/80; 362/372; 362/396

[58] Field of Search ..... 362/61, 77, 80, 100, 362/226, 278, 300, 306, 322, 364, 365, 368, 372, 396

[56] References Cited

U.S. PATENT DOCUMENTS

| | | | |
|---|---|---|---|
| 1,264,482 | 4/1918 | Berg | 362/365 X |
| 2,711,044 | 6/1955 | Woods | 362/120 X |
| 2,985,749 | 5/1961 | Johnson | 362/80 |
| 3,174,576 | 3/1965 | Woofter et al. | 362/80 X |
| 3,196,267 | 7/1965 | Abolins | 362/80 |
| 3,267,275 | 8/1966 | Kendall et al. | 362/396 X |
| 3,679,892 | 7/1972 | Shearer | 362/306 |
| 3,696,238 | 10/1972 | Szymanski | 362/293 |
| 3,710,097 | 1/1973 | Bright et al. | 362/80 X |
| 4,042,818 | 8/1977 | Green | 362/293 X |

*Primary Examiner*—Peter A. Nelson
*Attorney, Agent, or Firm*—Lon H. Romanski

[57] ABSTRACT

A lamp assembly, such as an indicator or illuminator type, has a main body structure detachably securable to an associated support as, for example, an instrument panel of a related vehicle, with such body structure enabling the easy connection thereto of an associated light shield; the light shield carries a separately formed resiliently deflectable detent member enabling easy assembly and disassembly of the shield with respect to the body structure as well as an infinite selection of angular adjustment of the shield relative to body structure.

17 Claims, 7 Drawing Figures

LAMP ASSEMBLY LIGHT SHIELD AND RETAINING MEANS

BACKGROUND OF THE INVENTION

Generally, in the automative field, especially with regard to trucks, indicator lamp assemblies are employed as to indicate, by their respective energization, that certain selected functions or vehicular operating parameters are in an unacceptable condition. For example, as in a truck, such indicator lamp assemblies may be operatively connected to related sender units which are, in turn, responsive to indicia of engine oil level, engine temperature, loss of engine coolant, generator or alternator output level, actuation or operation of anti-skid mechanism, air pressure in truck air tanks, headlamp selection (whether high or low beam), or parking brake engagement. Such indicator lamp assemblies often have a lens which emits a colored light upon energization of a bulb carried by the indicator lamp assembly and generally covered or contained by such lens.

There are other lighting requirements within, for example, the truck and especially along the instrument panel thereof. Often there is a need to have a continuous (or switchable) light source for illuminating a desired area as within the truck operator's compartment. This may be to illuminate certain controls which the operator may want to be able to quickly identify during night driving or to illuminate certain gauges or the like. The use of such a continuous illuminating light source as proposed by the prior art has presented problems in that often because of the light rays eminating therefrom in somewhat random direction the lenses of the related indicator assemblies would, in turn, be struck by such light rays and appear to indicate that the related indicator lamp assembly was energized when, in fact, it was not.

In an attempt to overcome this random light ray problem, hood-like structures were employed by the prior art in an attempt to control the path of the illuminating light rays. However, such prior-art hood-like structures, of necessity, were and are relatively large requiring the mounting thereof to, for example, the related lamp structure as by a collar like retainer and for threaded attachment means. Another problem of such prior art hoods is that once affixed to the related lamp assembly, the hood is fixed against further selective adjustment without employing, for example, tools and the like for first loosening the related attachment means. Further, the prior art illuminator hoods are not compatible with standard lamp body or socket structures. That is, they are usually limited to particular physical configurations of a lamp body and, more often than not, actually comprise a portion of a specially designed and built illuminator lamp assembly.

Accordingly, the invention as herein disclosed and claimed is primarily directed to the solution of the foregoing as well as other related and attendant problems.

SUMMARY OF THE INVENTION

According to the invention, an illuminator type lamp assembly comprises lamp body means, means formed on the lamp body means for enabling the lamp body means to be detachably secured to associated support structure, said lamp body means having a first open end for permitting the extension therethrough of an associated lamp bulb, a light shield generally covering said lamp bulb, said light shield having an opening formed in a wall portion thereof for the passage of light rays therethrough, and resilient detent means for operatively engaging said lamp body means for detachably holding the light shield in assembled relationship to said lamp body means and for enabling selective adjustable rotation of said light shield with respect to said lamp body means for achieving a selective direction of the light rays through said opening in said wall.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
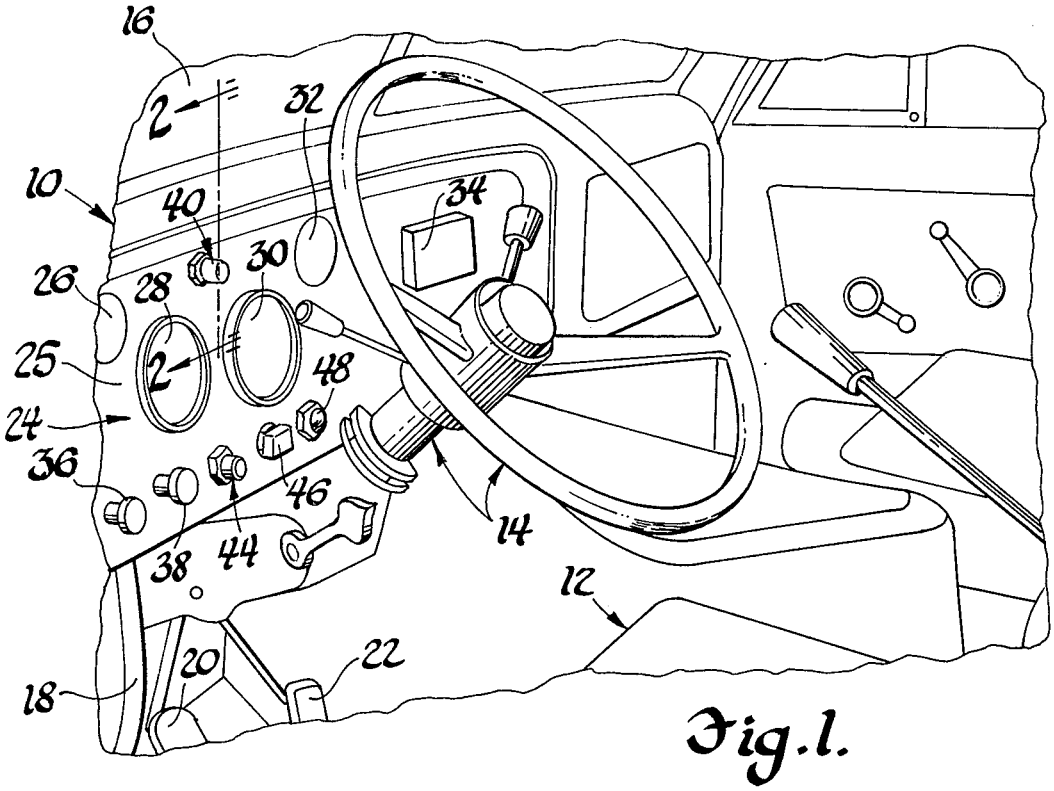
FIG. 1 is a fragmentary perspective view of an interior of a truck cab having an instrument panel employing an illuminator lamp assembly constructed in accordance with teachings of the invention.

Referring now in greater detail to the drawings, FIG. 1 illustrates the interior of a truck cab 10 as being comprised of, for example, a driver's or operator's seat assembly 12, steering wheel and column assembly 14, windshield 16, operator's foot actuated levers and pedals 18, 20 and 22, and instrument panel assembly 24 comprising a panel-like support 25 and an array of gauges 26, 28, 30, 32 and 34, controls 36, 38, a plurality of indicator lamp assemblies 44, 46 and 48 and an illuminator lamp assembly 40.

Figure 2:
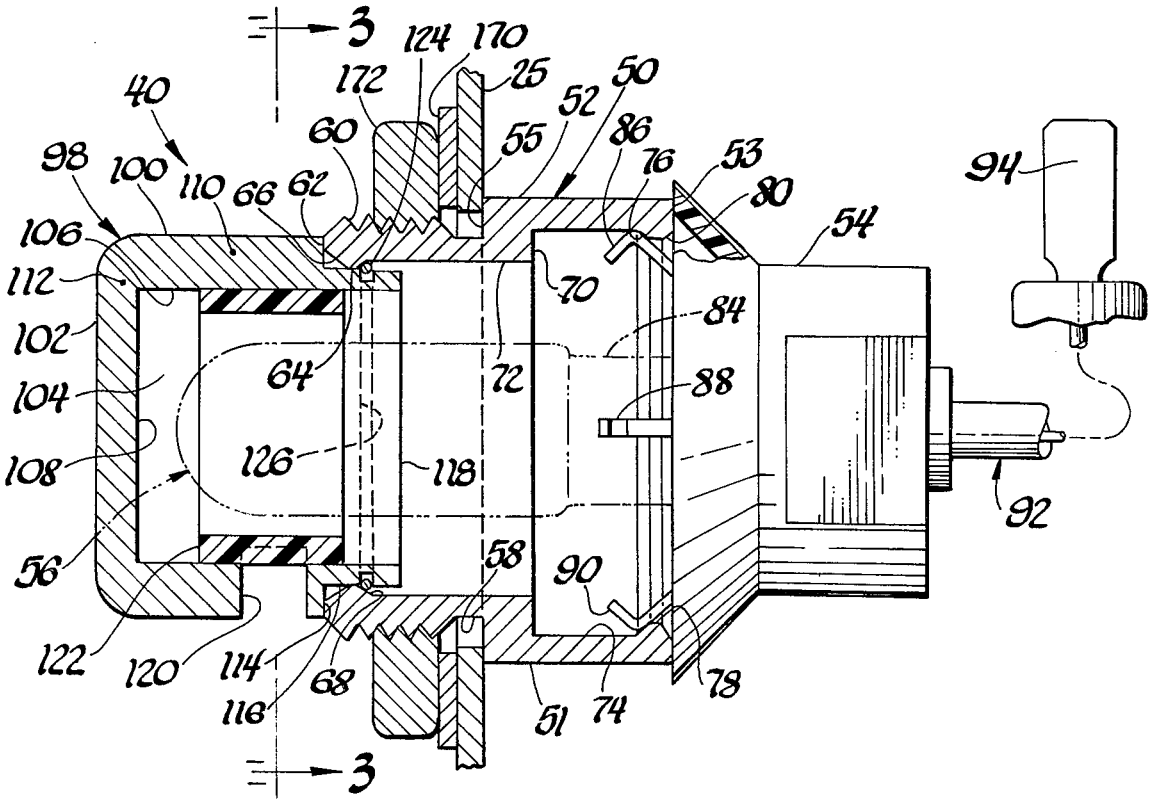
FIG. 2 is an enlarged view, partly in cross-section, taken generally on the plane of line 2—2 of FIG. 1 and looking in the direction of the arrows.

Referring in greater detail to FIG. 2, the illuminator lamp assembly 40 is illustrated as comprising lamp or bulb housing means 50 which, in turn, may be comprised of separable housing sections or housing body portions 52 and 54. The housing portion may be generally tubular having a relatively large outer cylindrical surface 51 terminating at the right end in a transverse end abutment surface 53 and terminating at the left end in a flange-like or shoulder surface 55 formed as by a diametrically necked-down portion 58. The left end of the body portion 52 may have an externally threaded portion 60 which extends from the necked-down portion 58 and terminates at its left in a transverse second end abutment surface 62.

A first clearance type passageway 64 within body portion 52 is defined as by the intersection of oppositely inclined annular ramp surfaces 66 and 68. As is evident from the drawings, ramp means 66 and 68 are so formed as to increase in effective diameter as such ramp means extend away from clearance passageway 64.

The second or inner ramp means 68, as it generally radiates away from passageway 64, terminates and/or blends into a second clearance passageway 72 which, as illustrated, may terminate in a radially outwardly directed shoulder or wall portion 70 formed as by a third further enlarged clearance passageway 74.

As depicted, clearance passageway 74, at its right or rearward end, may terminate as in a third generally radially inwardly directed annular incline or ramp surface 76 which, at its radially innermost end terminates as in a fourth clearance passageway 78. Similar to ramp surface 66, a generally annular incline or ramp surface 80 extends from clearance passageway 78 generally radially outwardly until it terminates in transverse end abutment surface 53.

Body or housing portion 54 may actually comprise a socket assembly formed of electrically non-conductive plastic material with a suitable centrally located cylindrical recess formed therein, as is well known in the art, adapted to receive therein the male plug-in portion 84 of a bulb assembly 56. Also, as is well known in the art, the male plug-in portion 84 may be of the bayonet lock type wherein a tab or lug carried at the side of portion 84 becomes locked against an electrically conductive member within the bulb-receiving recess while a spring loaded contact at the end of the recess engages the end of the portion 84 to thereby complete a circuit through and with bulb 56. As is further well known in the art, the electrically conductive member within the bulb-receiving recess may be physically and electrically connected to a plurality of generally annularly positioned detent-like resilient latching arms, three of which are shown at 86, 88 and 90, each effectively secured to body or housing portion 54. The detent or latching arms may be electrically conductive so that the grounding circuit can be affected as through body portion 52 and panel 25. As generally illustrated, an elongated wire harness 92 (in the embodiment of FIG. 2 such harness comprises a single electrical conductor) is operatively electrically connected at its inner end to the spring loaded contact within body portion 54 while the other end of harness 92 is provided with a suitable terminal contact 94 engageable with related wiring of, for example, the truck cab 10.

In the lamp housing means 50 depicted in FIG. 2, when housing portion 54 is brought toward cooperating housing portion 52, the forward inclined portions of latching arms 86, 88 and 90 operatively engage ramp surface 80 and, upon continued applied force, latching arms 86, 88 and 90 will resiliently deflect radially inwardly as to thereby pass through clearance passageway 78. Once such arms 86, 88 and 90 pass through the clearance passageway, the said latching arms, under their own inherent resilient force, move radially outwardly thereby causing the rearward inclined portions of such latching arms to respectively engage the ramp or annular locking surface 76. The dimensions and configurations of the respective cooperating elements would preferably be such as to cause forward end surface 96 of housing portion 54 to be in abutting relationship with housing end surface 53 prior to latching arms 86, 88 and 90 dissipating all of the inherent resilient force thereby assuring a sound latched engagement as between housing body portions 52 and 54.

As should be apparent, the invention as herein disclosed is not restricted to lamp or bulb socket or body means comprised of two or more separable housing sections or portions. The invention may be practiced equally well where the related lamp or bulb socket or body means comprises a single unitary structure.

Figure 3:
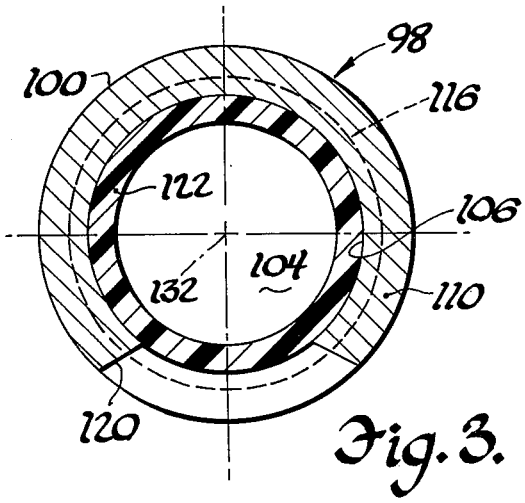
FIG. 3 is a cross-sectional view taken generally on the plane of line 3—3 of FIG. 2 and looking in the direction of the arrows.
Figure 4:
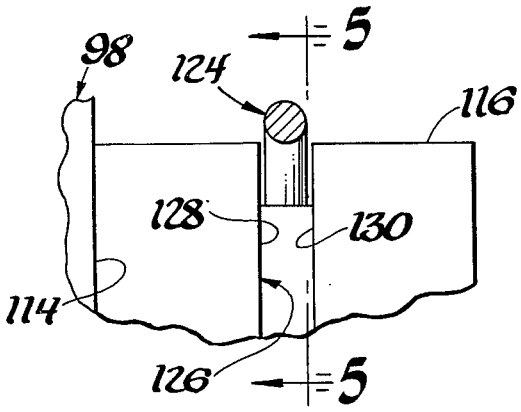
FIG. 4 is an enlarged view of a fragmentary portion of structure shown in FIG. 2.
Figure 5:
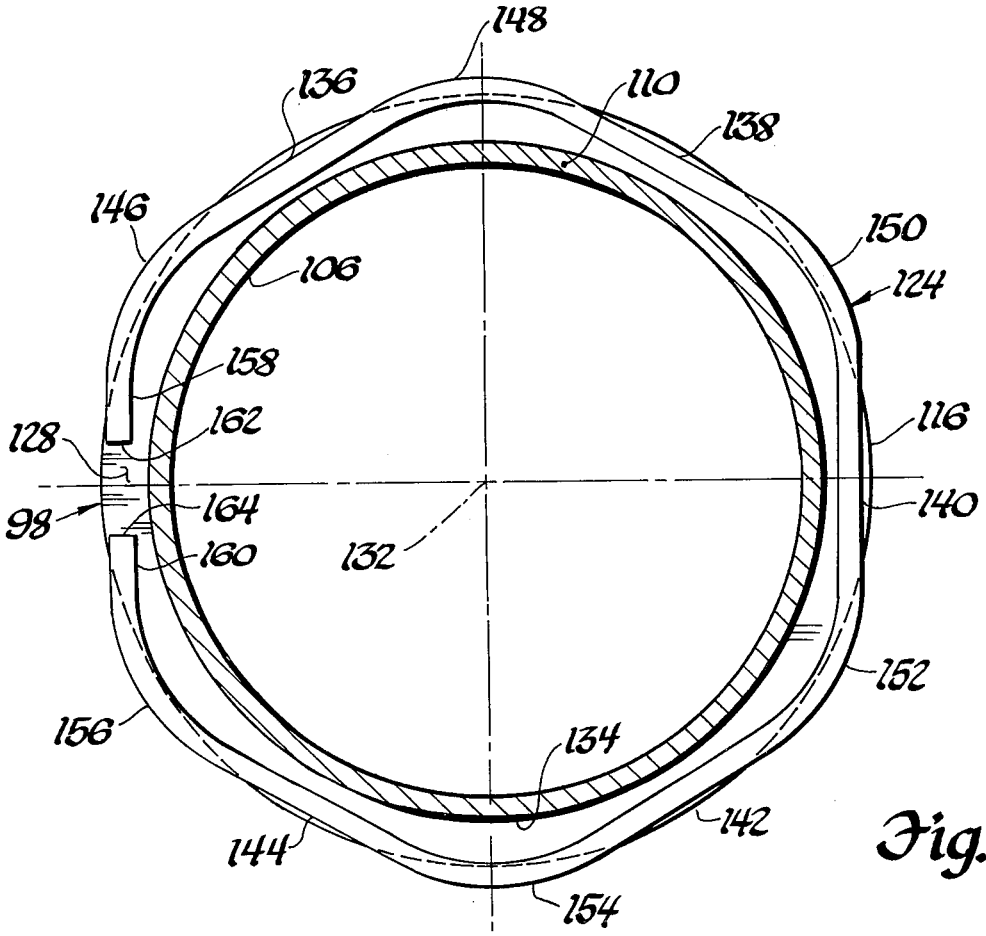
FIG. 5 is a cross-sectional view taken generally on the plane of line 5—5 of FIG. 4 and looking in the direction of the arrows.

FIG. 2, as well as FIGS. 3, 4 and 5, illustrate a light or lamp shield structure 98. In the embodiment disclosed the shield 98 is of a generally cup-like configuration having a first outer cylindrical surface 100 which terminates at or blends into a generally transverse forward or outer end surface 102. Further, in the preferred embodiment, the interior of shield structure 98 is provided with a chamber 104 which may have generally cylindrical surface 106 and which, at its left (as viewed in FIG. 2) or outermost end terminates as in an inner generally transverse surface 108. As can be seen, preferably walls 110 and 112, which respectively define surfaces 100, 106 and 102, 108, are formed integrally with each other. Although not so limited, in the preferred embodiment of the invention shield structure 98 is formed of metal such as, for example, an aluminum alloy.

Still referring to FIG. 2, wall 110 has an annular generally radiating flange or abutment surface 114 which, at its radially inner end, terminates as in a second outer cylindrical surface 116 which, along with inner cylindrical surface 106, terminates at its inner or right end (as viewed in FIG. 2) in a generally transverse end surface 118. The wall 110 also has a slot-like opening 120 formed therein for permitting the passage of light therethrough. Further, in the preferred embodiment, a generally tubular light filter 122 is carried within chamber 104. In this regard it is preferred that the relative dimensions of light filter 122 and surface 106 be such as result in a slight interference fit therebetween as to have light filter 122, in effect, press-fitted into chamber 104. Such filter 122 may be made of any suitable material; however, in the preferred embodiment of such a filter, it was formed of a translucent white polycarbonate. As shown in FIGS. 2,4 and 5, a generally resilient retainer member 124 is carried by shield 98 as within an annular groove 126 formed into the body or wall 110 through surface 116.

Referring in greater detail to FIGS. 4 and 5, each of which is in a relatively substantially enlarged scale, the groove or annular recess 126 is preferably formed as to have opposed annular wall surfaces 128 and 130 which are preferably substantially parallel to each other and generally normal to the axis 132 of shield 98. The side walls 128 and 130 each terminate, as at their radially innermost portion, in a generally cylindrical wall surface 134.

As shown in FIGS. 4 and 5, in the preferred form, retainer 124 is generally circular in transverse cross-section (FIG. 4) and formed into a generally hexagonal configuration (FIG. 5). As can be seen in FIG. 5, the retainer 124, preferably formed of tempered spring steel, comprises a plurality of generally straight or chordal portions 136, 138, 140, 142 and 144 which, as depicted, are integrally joined to arcuate or lobe like portions 146, 148, 150, 152, 154 and 156. Further, as also illustrated lobe portions 146 and 148 have respective chordal portions 158 and 160 which, in turn, terminate as at ends 162 and 164 normally spaced from each other.

As can be seen, the generally inner mid-points or surfaces of chordal or leg-like portions 136, 138, 140, 142, 144, 160 and 158 limit the degree of translational movement which retainer 124 may freely experience relative to wall 110 by abuting engagement with groove or recess outer surface 134. In the preferred embodiment, the relative dimensions are such as to preclude translational movement of any chordal or leg portion beyond a distance where the entire axis thereof is radially outwardly of the radially outermost edge of wall 128 or wall 130. Accordingly, even though such retainer means 124 is generally confined within groove 126 and about surface 134 (which, in effect, functions as a pilot-like portion for retainer means 124) the lobe portions 146, 148, 150, 152, 154 and 156 normally project radially outwardly of the outer cylindrical surface 116.

Therefore, as the shield 98, assumed to be at this time separated from housing means 50, is brought toward housing portion 52 for assembly thereto, lobes or projections 146, 148, 150, 152, 154 and 156 will engage the outer-most ramp surface means 66 and, upon further applied force and movement of shield 98 towards housing section 52, ramp means 66 causes the respective lobes 146, 148, 150, 152, 154 and 156 to move generally radially inwardly toward axis 132. In so doing, of course, spaced ends 162 and 164 move generally toward each other. When thusly sufficiently radially compressed, retainer means 124 passes through clearance aperture 64 and then, because the inherent resilient force thereof, starts to expand radially outwardly and, in so doing, continually engaging the inner ramp or locking surface means 68. Preferably prior to retainer means 124 becoming fully expanded, abutment or shoulder surface 114 of shield 98 engages forward cooperating end surface 62. Accordingly, retainer means 124, simultaneously pressing against recess wall 130 and ramp surface 68, serves to tightly hold shield 98 in assembled relationship to housing means 50.

By having the radially outermost portion of the retainer 124 curved (as viewed in transverse cross-section) it becomes easier to cause radial inward deflection thereof by ramp means 66 during assembly thereof since, regardless of the degree of compression experienced by retainer 124, the outer engaging surface of such lobes is always tangential to the cooperating ramp surface 66.

The retaining arrangement herein disclosed is particularly suitable in those instances where the respective components are relatively quite small and do not permit a convential type of detent locking or latching means because of size limitations. For example, in one successful embodiment of the structure herein disclosed: the nominal diameter of surface 116 was 0.525 inch; the nominal diameter of cylindrical groove surface 134 was 0.485 inch; the width of groove or recess 126 (the distance between walls 128 and 130) was 0.017 inch; the nominal transverse cross-sectional diameter of retainer 124 was 0.015 inch; the nominal diametral distance or clearance between opposed chordal sections of retainer 124 (in its normal or free state) was 0.470 inch; and the nominal diameter of cooperating clearance passageway 64 was 0.530 inch. It should be apparent that with such working dimensions, especially where a clearance aperture is only 0.530 inch in diameter and one has to pass a tubular member therethrough and yet provide a means of detachably locking such tubular member within the clearance passageway, that the prior art means of flat stock C-clip type retainers or the like simply are not employable because of, among other things, the space required to achieve the necessary degree of deflection. In the arrangement disclosed, especially when viewing FIG. 5, it can be seen that as the retainer lobes are forced generally radially inwardly that the radially inner surface of the chordal portions may reach a point where they engage groove surface 134. Any further required radial inward movement such lobes is accomplished with an attendant bending moment experienced as by an adjoining chordal portion bending generally about surface 134. Accordingly, in the arrangement disclosed, it is apparent that the retainer means 124, while undergoing radially directed compression, continually seeks to equalize the forces being experienced by it throughout its entire structure rather than localize forces in any single area for deflection.

Once the shield structure is assembled, as hereinbefore described, the frictional engagement among the various cooperating elements serves to hold the shield structure 98 in any selected position relative to housing means 50. However, if it should be desired to reposition shield 98 as to re-direct the path of light rays, passing through opening 120, all that needs to be done is to firmly grasp the shield 98 and rotate it either clockwise or counter-clockwise, as viewed in FIG. 3, and thereby angularly reposition slot or cut-out 120 to, in turn, redirect the path of light passing therethrough. Once thusly repositioned, the shield 98 will remain in such selected attitude because of the friction existing as among surfaces 62, 114 and cooperating elements 124, 68 and 130.

The entire illuminator assembly may be supported as on related support or panel means 25 and retained thereagainst as by a washer member 170 and nut 172 cooperating with threaded portion 60.

Figure 6:
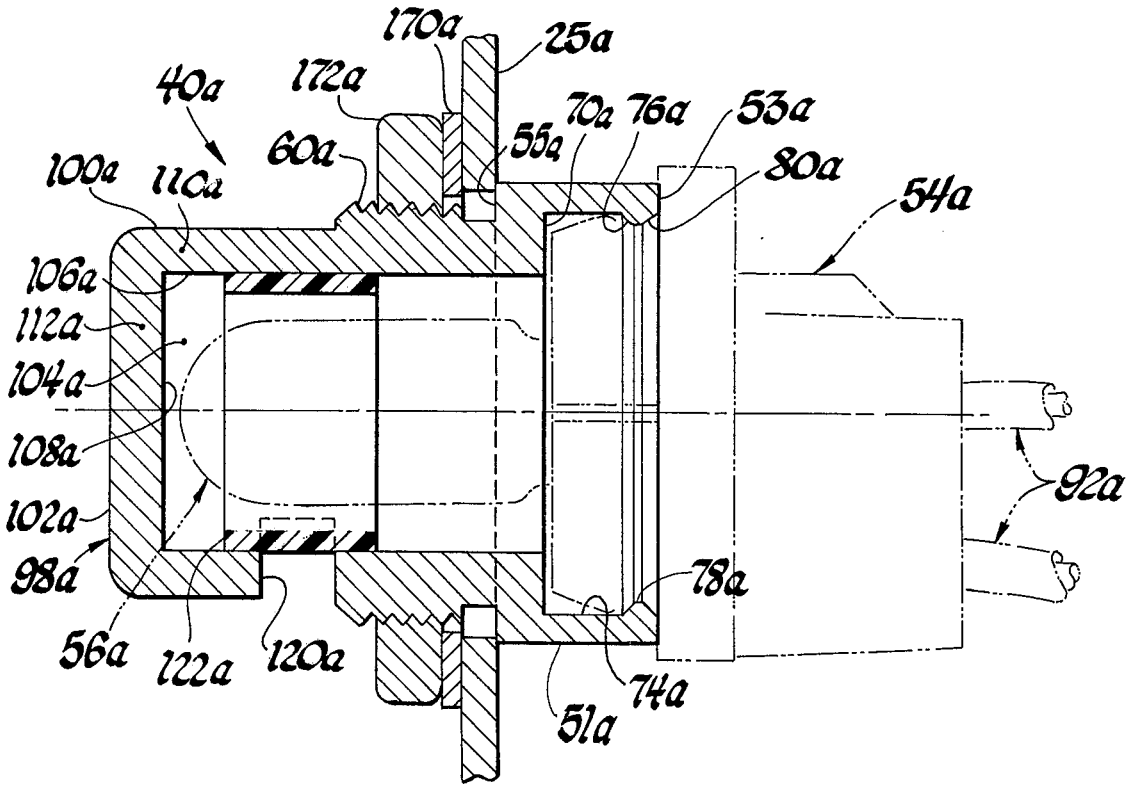
FIG. 6 is a view similar to that of FIG. 2 but illustrating another form of the invention.

FIG. 6 illustrates another embodiment of a light shield assembly. All elements in FIG. 6 which are like or similar to those of preceding Figures are identified with like reference numbers provided with a suffix "a".

Referring in greater detail to FIG. 6, and by way of comparison referring also to FIG. 2, it can readily be seen that, in the main, shield structure **98*a* is comprised as of shield 98 and body portion 52 of FIG. 2. That is, in the embodiment of FIG. 6, the inner surface 106*a* now extends to and terminates in annular wall 70*a* and threaded portion 60*a* and enlarged outer surface 51*a* are now an integral portion of the wall portion 110*a* as are ramp surfaces 76*a*, 80*a* and enlarged inner surface 74*a*. In the preferred form of the embodiment of FIG. 6, the surfaces 76*a* and 80*a* are preferably circumferentially continuous and the entire shield structure 98*a***, although able to be formed of any suitable material, is formed of metal such as, for example, aluminum alloy.

As can be seen, the shield structure **98*a* of FIG. 6 is particularly suitable for those situations where, for any related reason, it is desirable to remove or otherwise service the bulb 56*a* from the rear of the support panel 25*a*. That is, the shield structure 98*a* is itself detachably secured to the support 25*a* as by the washer member 170*a* and nut 172*a* while, in turn, the bulb socket body portion 54*a* is detachably supported by the shield structure 98*a***.

Figure 7:
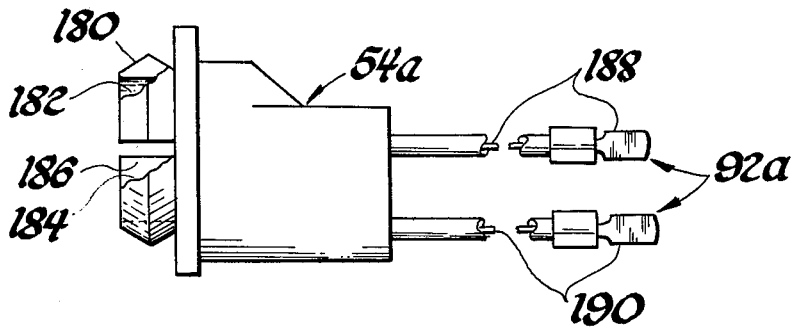
FIG. 7 is a side elevational view of one form of a bulb socket housing, in somewhat relatively reduced scale, employable in the practice of the invention as depicted, for example, in FIG. 6.

FIG. 7, by way of example and not of limitation, illustrates one particular type of bulb socket body portion or means **54*a*. As thusly depicted, the socket body means 54*a* may be of plastic or other suitable electrically non-conductive material. The main difference from the body portion 54 of FIG. 2 is that body or housing means 54***a* has integrally formed electrically non-conductive annularly situated detent or latching members 180, 182, 184 and 186 (which function in the manner of latch means 86, 88 and 90) and a plurality of extending electrical conductors 188, 190, comprising the wiring harness 92*a* as to achieve, for example, a remote ground connection. There are also many other types of such bulb socket housing means, well known in the art, employable in the practice of the invention.

Although only a preferred embodiment and selected modification of the invention has been disclosed and described, it is apparent that other embodiments and modifications of the invention are possible within the scope of the appended claims.

I claim:

1. A light shield for detachable connection to associated support structure, comprising a shield main body portion, said main body portion comprising a generally relatively forwardly disposed first closed end and a generally relatively rearwardly disposed second end, a recess-like cavity formed in said main body portion, said cavity having an end opening in said second end for receiving at least a portion of an associated bulb means therein, aperture means formed in said main body portion generally transversely thereof as to be located generally between said first and second ends, said aperture means permitting the passage therethrough of light rays generated by said associated bulb means, and light ray filter means, said filter means being situated within said cavity and fixedly secured to and carried by said main body portion in a manner at least partly covering said aperture means.

2. A light shield for detachable connection to associated support structure, comprising a shield main body portion, said main body portion comprising a generally relatively forwardly disposed first closed end and a generally relatively rearwardly disposed second end, a recess-like cavity formed in said main body portion, said cavity having an end opening in said second end for receiving at least a portion of an associated bulb means therein, aperture means formed in said main body portion generally transversely thereof as to be located generally between said first and second ends, said aperture means permitting the passage therethrough of light rays generated by said associated bulb means, and light ray filter means, said filter means being generally tubular and carried by said main body portion within said cavity as to cover said aperture means, said filter means being at least translucent.

3. A light shield according to claim 2 wherein said filter means is fixedly retained within said cavity by an interference fit between said filter means and the surface defining said cavity.

4. A light shield according to claim 2 wherein said filter means has an inner opening effective for at least partly receiving therein said associated bulb means.

5. A light shield for detachable connection to associated support structure, comprising a shield main body portion, said main body portion comprising a generally relatively forwardly disposed first closed end and a generally relatively rearwardly disposed second end, a recess-like cavity formed in said main body portion, said cavity having an end opening in said second end for receiving at least a portion of an associated bulb means therein, aperture means formed in said main body portion generally transversely thereof as to be located generally between said first and second ends, said aperture means permitting the passage therethrough of light rays generated by said associated bulb means, a generally annular and continuous groove carried by said main body portion as to circumscribe said main body portion, and a resiliently deflectable retainer member continuously contained by said groove as to thereby be movably carried by said main body portion, said retainer member comprising a plurality of integrally interconnected lobe-like portions, said retainer member when in its normal state having a plurality of said lobe-like portions projecting beyond the confines of said groove, said retainer member upon experiencing sufficient force being effective to undergo resilient deflection whereby all of said plurality of integrally interconnected lobe-like portions are totally received within the confines of said groove.

6. A light shield for detachable connection to associated support structure, comprising a shield main body portion, said main body portion comprising a generally relatively forwardly disposed first closed end and a generally relatively rearwardly disposed second end, a recess-like cavity formed in said main body portion, said cavity having an end opening in said second end for receiving at least a portion of an associated bulb means therein, aperture means formed in said main body portion generally transversely thereof as to be located generally between said first and second ends, said aperture means permitting the passage therethrough of light rays generated by said associated bulb means, a generally annular groove carried by said main body portion, and a resiliently deflectable retainer member generally contained by said groove, said retainer member comprising a plurality of integrally interconnected lobe-like portions, said retainer member when in its normal state having a plurality of said lobe-like portions projecting beyond the confines of said groove, said retainer member further comprising a plurality of chordal-like portions, said chordal-like portions being integrally formed with and between succeeding ones of said lobe-like portions, said retainer member being discontinuous as to have first and second retainer ends, said first and second retainer ends being spaced from each other and generally juxtaposed to each other when said retainer member is in its said normal state, said first and second retainer ends being formed in one of said chordal-like portions.

7. A light shield for detachable connection to associated support structure, comprising a shield main body portion, said main body portion comprising a generally relatively forwardly disposed first closed end and a generally relatively rearwardly disposed second end, a recess-like cavity formed in said main body portion, said cavity having an end opening in said second end for receiving at least a portion of an associated bulb means therein, aperture means formed in said main body portion generally transversely thereof as to be located generally between said first and second ends, said aperture means permitting the passage therethrough of light rays generated by said associated bulb means, a generally annular groove carried by said main body portion, and a resiliently deflectable retainer member generally contained by said groove, said retainer member comprising a plurality of integrally interconnected lobe-like portions, said retainer member when in its normal state having a plurality of said lobe-like portions projecting beyond the confines of said groove, said retainer member further comprising a plurality of chordal-like portions, said chordal-like portions being integrally formed with and between succeeding ones of said lobe-like portions, said groove comprising an inner annular piloting surface, said piloting surface engaging at least one of said chordal-like portions upon resilient deflection of said lobe-like portions toward said piloting surface.

8. A light shield for detachable connection to associated support structure, comprising a shield main body portion, said main body portion comprising a generally relatively forwardly disposed first closed end and a generally relatively rearwardly disposed second end, a recess-like cavity formed in said main body portion, said cavity having an end opening in said second end for receiving at least a portion of an associated bulb means therein, aperture means formed in said main body portion generally transversely thereof as to be located generally between said first and second ends, said aperture means permitting the passage therethrough of light rays generated by said associated bulb means, said main body portion comprising first and second outer surfaces, generally laterally extending first abutment surface means carried by said main body portion situated as to be generally between said first and second outer surfaces, said second outer surface being of a periphery substantially less than the periphery of said first outer surface, and further comprising light ray lens-like means, said lens-like means being carried within said cavity as to cover said aperture means, said lens-like means being generally tubular thereby defining a general medial opening effective for at least partly receiving therein said associated bulb means, a generally annular groove formed in said second outer surface, and a resiliently deflectable retainer member generally contained by said groove, said retainer member comprising a plurality of integrally interconnected lobe-like portions, said retainer member when in its normal state having a plurality of said lobe-like portions projecting beyond the confines of said groove, said retainer member further comprising a plurality of chordal-like portions integrally formed with and between succeeding ones of said lobe-like portions, said retainer member being discontinuous as to have first and second retainer ends, said first and second retainer ends being spaced from each other and generally juxtaposed to each other when said retainer member is in its said normal state, said first and second retainer ends being formed in one of said chordal-like portions.

9. A light shield according to claim 5 and further comprising light ray filter means, said filter means being fixedly secured to said main body portion within said cavity as to at least partly cover said aperture means and be movable in unison with said main body portion.

10. A light shield according to claim 6 and further comprising light ray filter means, said filter means being carried by said main body portion in a manner at least partly covering said aperture means.

11. A light shield according to claim 6 and further comprising light ray filter means, said filter means being fixedly secured to said main body portion within said cavity as to at least partly cover said aperture means and be movable in unison with said main body portion.

12. A light shield according to claim 9 wherein said filter means is fixedly secured within said cavity by an interference fit between said filter means and surface defining said cavity.

13. A light shield according to claim 10 wherein said filter means is fixedly secured within said main body portion.

14. A light shield according to claim 11 wherein said filter means is fixedly secured within said cavity by an interference fit between said filter means and surface defining said cavity.

15. A light shield according to claim 7 and further comprising light ray filter means, said filter means being carried by said main body portion in a manner at least partly covering said aperture means.

16. A light shield according to claim 7 and further comprising light ray filter means, said filter means being fixedly secured to said main body portion within said cavity as to at least partly cover said aperture means and be movable in unison with said main body portion.

17. A light shield according to claim 16 wherein said filter means is fixedly secured within said cavity by an interference fit between said filter means and surface defining said cavity.

* * * * *